US006874820B2

(12) United States Patent
Michlin et al.

(10) Patent No.: US 6,874,820 B2
(45) Date of Patent: Apr. 5, 2005

(54) BLANK AND METHOD FOR MAKING COUPON CARDS

(76) Inventors: Irving R. Michlin, 29 David Rd., Salt Point, NY (US) 93010; Ronald Eisele, 132 Estaban, Camarillo, CA (US) 93010

( * ) Notice: Subject to any disclaimer, the term of this patent is extended or adjusted under 35 U.S.C. 154(b) by 0 days.

(21) Appl. No.: 10/243,179

(22) Filed: Sep. 13, 2002

(65) Prior Publication Data

US 2004/0051301 A1 Mar. 18, 2004

(51) Int. Cl.[7] ..... B42D 15/00

(52) U.S. Cl. ..... 283/108; 283/61; 283/81; 283/101; 283/106; 428/40.1; 428/42.2; 428/42.3; 428/43

(58) Field of Search ..... 283/51, 56, 61, 283/62, 81, 101, 94, 98, 103, 108, 105, 106, 109; 428/40.1, 41.7, 41.8, 42.1, 42.2, 212.3, 41.9, 43

(56) References Cited

U.S. PATENT DOCUMENTS 3,994,089 A * 11/1976 Schwartz ..... 40/310
5,417,458 A * 5/1995 Best et al. ..... 283/51
6,241,287 B1 * 6/2001 Best et al. ..... 283/51
6,520,542 B2 * 2/2003 Thompson et al. ..... 283/51
2002/0084649 A1 * 7/2002 Casagrande ..... 283/98

* cited by examiner

*Primary Examiner*—Monica S. Carter
(74) *Attorney, Agent, or Firm*—Francis C. Hand; Carella, Byrne, Bain

(57) ABSTRACT

The blank is made of a sheet of paper of a size suitable for processing through imaging machines, such as ink jet printers and laser printers. For example, the blank may be made 8½ by 11½ inches. The blank includes a front side for receiving printing thereon and at least one removable section in the card. The removable section is formed with a fold line that divides the section into two equal parts for subsequent folding onto each other. Both parts of the removable section are coated with an adhesive on the back side and a polymer sheet, for example, of polyester, is provided over the adhesive on one part of the removable section. A backing sheet, for example, of silicone coated paper is provided over the adhesive on the other part of the removable section. The blank may be provided with a plurality of removable sections so that multiple coupons may be formed from a single blank. In addition, the blank may be printed on both the front side and back side in order to provide information.

18 Claims, 2 Drawing Sheets

BLANK AND METHOD FOR MAKING COUPON CARDS

This invention relates to a blank for making coupon cards along with a method of forming a coupon card.

The blank is made of a sheet of paper of a size suitable for processing through imaging machines such as ink jet printers and laser printers. For example, the blank may be made 8½ by 11½ inches. The blank includes a front side for receiving printing thereon and at least one removable section in the card.

The removable section is further formed with a fold line that divides the section into two equal parts for subsequent folding onto each other.

Both parts of the removable section are coated with an adhesive on the back side and a polymer sheet, for example, of polyester, is provided over the adhesive on one part of the removable section. A backing sheet, for example, of silicone coated paper is provided over the adhesive on the other part of the removable section.

The blank may be provided with a plurality of removable sections so that multiple coupons may be formed from a single blank.

In addition, the blank may be printed on both the front side and back side in order to provide information. For example, one of the parts of the removable section may have address indicia printed thereon, while the other of the parts has coupon indicia imprinted hereon.

Further, one of the parts of the removable section is provided with a grid of lines of weakening, e.g. perforations or die cuts, in order to subdivide the part into individually removable sub-sections, each of which is suitable to form a label or small coupon. Each of the coupons may have adhesive on the back so that the coupon can be attached to another document, such as a sales record. Printing of a blank may be such that each sub-section, i.e., label, has an individualized message printed thereon different from the other of the sub-sections.

The removable section may also be provided with a centrally disposed strip that extends between the removable sub-sections and is to remain in place.

Typically, the sheet of paper is made of a heavier weight stock. For example, for purposes of ink-jet printing, use may be made of a Boise Cascade 41# Matte Finish Ink Jet stock and for laser printers, use may be of Boise Cascade 100# Tag X paper or Mead 100# Luna Matte Finish C1S Cover paper.

The invention also provides a method of forming a coupon card from the blank. In this respect, the blank may be printed in a suitable imaging system, such as an ink-jet printer or a laser printer or other type of imaging machine. Next, the paper backing is removed from over one of the halves of the removable section to expose the adhesive thereon. The removable section is then removed from the sheet of paper and folded along the fold line in order to place the two parts of the removed section in overlying and adhesively secured relation to each other. In this respect, the exposed adhesive on one half of the removed section adheres to the polymer sheet on the other half of the removed section to form a three layer card.

The individual sub-sections of the card may be removed from time-to-time for various uses. For example, each sub-section label may be peeled from the card and applied to another substrate. To this end, the adhesive which is used on the back of the label is such as to allow the label to be peeled from the polymer sheet sandwiched within the card.

In some cases, it may also be possible to remove the backing sheet and to then fold the sheet of paper about the fold line of the removable section. In this embodiment, the removable section is removed in the folded condition.

The blank may be processed in various manners. For example, the entire front surface of the blank may be printed. Alternatively, the face side of the blank may be printed in the sections, other than the removable sections, and then personalized (imaged) in the removable sections.

In some cases, the blank may be printed with information and mailed to a recipient who would then remove the removable section in order to form a coupon card by removing the removable section and folding the removed section in half in a manner as described above.

In another embodiment, a plurality of blanks may be partially printed and sent to a customer who would then finish one or more print and mail the blanks to the ultimate consumers.

Still further, one or more blanks may be forwarded to a customer who would then print the information desired on the removable sections and/or the remainder of the sheet or blank. Printing can then be done on an ink jet printer, laser printer or other imaging device.

In still another embodiment, the face of the blank and particularly the face of the removable section may be provided with a transparent laminate, for example, of a polymer, such as described in U.S. Pat. No. 5,417,458.

Further details of the invention will become more apparent from the following detailed description taken in conjunction with the accompanying drawings wherein.

Figure 1:
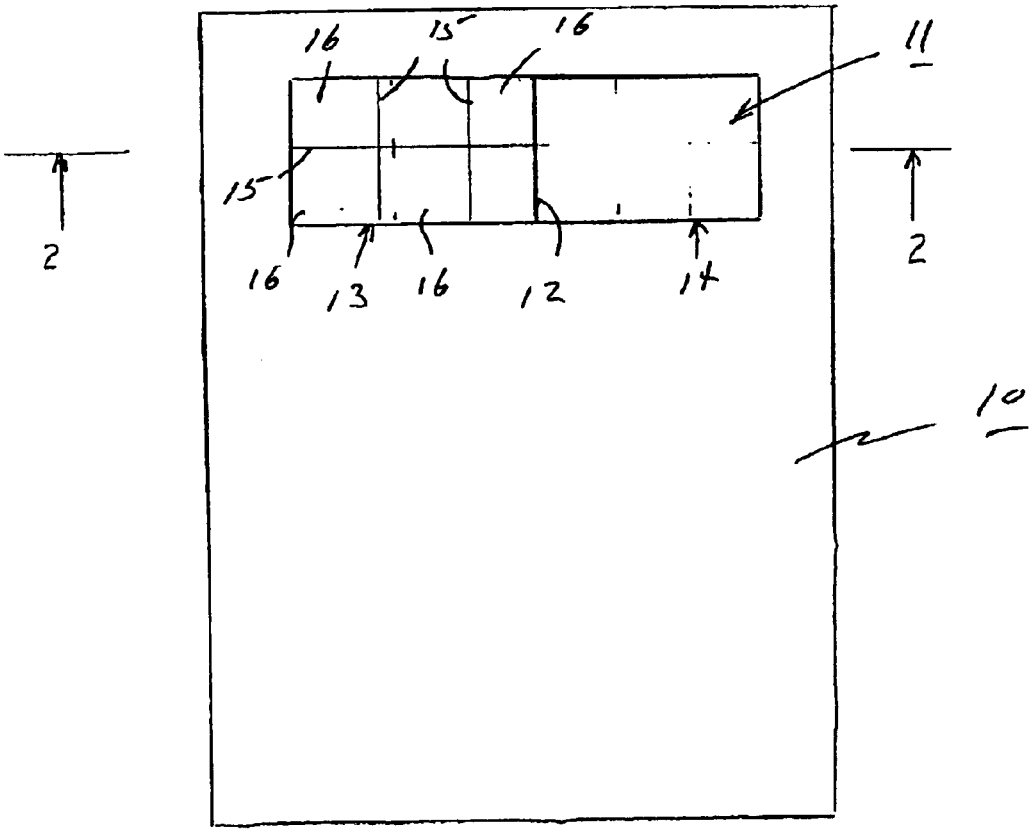
FIG. 1 illustrates one embodiment of a blank for making coupon cards in accordance with the invention.

As illustrated, the blank 10 which is comprised of a sheet of paper having a front side for receiving printing thereon and at least one removable section 11 therein.

The removable section 11 includes a fold line 12 for dividing the section 11 into two equal parts 13, 14. As illustrated, one part 13 of the removable section 11 is provided with a grid of die cut or perforated lines 15 to subdivide the part 13 into individually removable sub-sections or labels 16. The second part 14 of the removable section 11 is smooth and uninterrupted.

Figure 2:
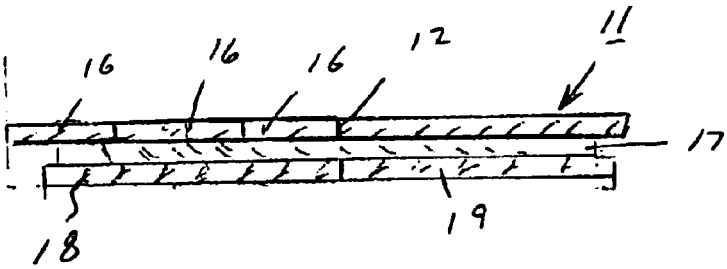
FIG. 2 illustrates an enlarged exaggerated view taken on line 2—2 of FIG. 1.

Referring to FIG. 2, a layer of adhesive 17 covers over the entire surface of the removable section 11 while also providing a rectangular frame of adhesive about the outline of the removable section 11. This adhesive may be of any suitable type, such as a pressure-sensitive adhesive.

A polymer sheet 18, for example, of transparent polyester material is disposed over the sub-divided part 13 to protect the adhesive layer 17 thereon but does not extend over the adhesive on the undivided part 14.

A backing layer 19, for example of silicone coated paper, is removably mounted over the undivided part 14 of the removable section 11 in order to cover over and protect the adhesive layer 17 thereon.

Alternatively, a silicon sheet may be placed over the adhesive layer 17 rather than using the two layers 18, 19 shown in FIG. 2. In this case, the adhesive layer 17 would be formed on parts 13, 14, for example, by being spot or flood coated, and the silicon coated backing sheet would be placed over the adhesive layer 17. The silicone sheet would be slit in the area adjacent to the fold line 12 so that the portion behind the part 14 would be separated from the card or remain with the blank 10.

In order to process the card, one half of the backing sheet would be removed from over one of the parts 13, 14 to expose the adhesive layer 17 thereon. The two parts 13, 14 would then be folded, as above, to sandwich the remaining half of the backing sheet therebetween.

In use, the blank 10 shown in FIG. 1 may be fed through a laser printer or ink-jet printer for imaging purposes. During this time, the entire surface or selected areas of the front side of the blank 10 receives printing thereon. Advantageously, the imaging of one side of the blank 10 allows for printing of the front and back of the resultant card.

After imaging, the blank 10 may be forwarded to a customer or directly to an ultimate consumer.

Where a multiplicity of printed blanks are forwarded to a customer, the customer may then personalize each blank relative to an ultimate consumer.

Where the blank is used to make a coupon card, the individual removable sections (labels) 16 may be provided with printed information different from the other sections 16.

After a blank has been printed and a coupon card is to be made, the backing layer 19 is removed from over the adhesive layer 17 on the part 14 of a removable section 11. Next, the removable section 11 is punched out or otherwise removed from the sheet of paper and folded over along the fold line 12 so that the two parts 13, 14 come into overlying relation with the polymer sheet 18 sandwiched therebetween. In this way, the adhesive on the part 14 adheres to the polymer layer 18. The resulting structure forms a card from which the individual sections 16 may be separately removed with adhesive 17 thereon. The removed section, or label, may then be adhesively secured to another substrate. In this respect, the adhesive 17 is of a nature to be secured to the polymer layer 18 and to be peelable therefrom for adhesive securement to another substrate. Alternatively, the adhesive 17 may be of a nature not to be secured to another substrate, that is, the adhesive may be a dry adhesive or desensitized adhesive that does not stick to another substrate. Also, the entire coupon card 11 can be removed leaving the silicone backing layer attached to the blank 10.

Figure 3:
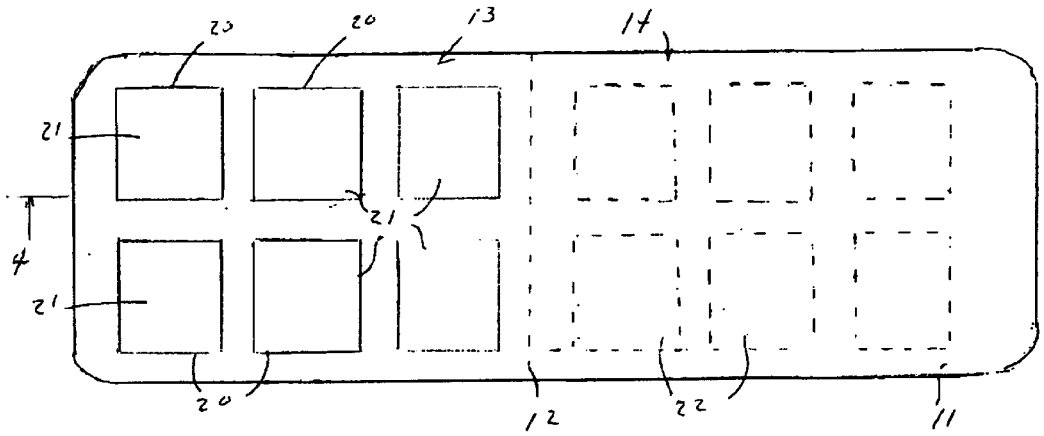
FIG. 3 illustrates a second embodiment of a coupon card constructed in accordance with the invention.
Figure 4:
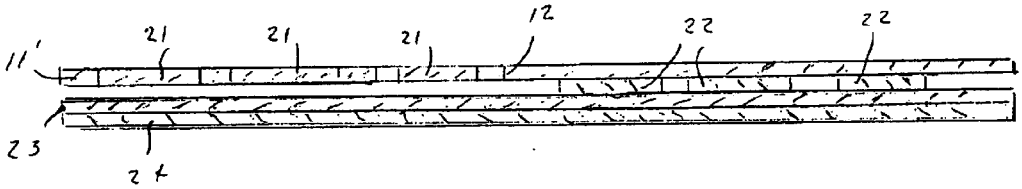
FIG. 4 illustrates an exaggerated cross-section view taken on line 4—4 of FIG. 3.

Referring to FIGS. 3 and 4, wherein like reference characters indicate like parts as above, in another embodiment, a removable section 11' which has been removed from a blank, as above, includes a fold line 12 for dividing the section 11' into two equal parts 13, 14.

As illustrated to the left in FIG. 3, one part 13 is provided with die cut lines 20 or is perforated for removal to form individually removable labels 21 therein. The second part 14 is provided with spots 22 of adhesive such as spot silicone or a special varnish on the back side. These spots 22 are positioned to overlay the back side of the labels 21 when the section 11' is folded about the fold line 12.

Referring to FIG. 4, a layer of adhesive 23 is applied over the entire back surface of the section 11' and covers the silicone spots 22. The layer of adhesive 23 may also be applied to cover only those areas of the section 11' not occupied by the silicone spots 22.

A backing sheet 24, for example of silicone coated paper, is removably mounted over the adhesive layer 23 on the back side of the section 11'.

In use, the backing layer 24 is removed in order to expose the adhesive layer 23. The section 11' is then folded about the fold line 12 so that the two parts 13, 14 are adhered to each other to form a card with removable labels 21. At the same time, the silicone spots 22 are positioned under the labels 21 and the adhesive on the back of the labels 21.

One or more labels 21 may be removed from the coupon card by peeling off from the silicone spots 22. At this time, the adhesive from the adhesive layer 23 remains on the removed label 21 to allow the label 21 to be adhered to another substrate, such as a sales record. Note is made that the adhesive does not adhere to the silicone spots 22.

Where the adhesive 23 is of a desensitized type, the labels 21 that are removed may be used in a manner other than to stick to another substate.

The removable sections 11,11' may be pre-printed on the back side prior to the adhesive layers 17,23 and silicone spots 22 being applied. Thus, when a label 16,21 is removed, the printing may be exposed to view through the polymer sheet 18 or silicone spot 22, as the case may be. In this way, a message may be progressively displayed to the user as each label 16,21 is removed.

What is claimed is:

1. A blank comprising a sheet of paper having a front side for receiving printing thereon and at least one removable section therein, said removable section including a fold line for dividing the section into two equal parts, one of said parts having a grid of perforated lines to subdivide said one part into individually removable sub-sections, the other of said parts being smooth and uninterrupted;

a layer of adhesive over the entire surface of said removable section, said layer providing a rectangular frame of adhesive about the outline of said removable section;

a polymer sheet disposed over said one part of said removable section to protect said adhesive layer thereon; and a backing layer removably mounted over said other part of said removable section to cover over and protect said adhesive layer thereon.

2. A blank as set forth in claim 1 wherein said adhesive is pressure sensitive.

3. A blank as set forth in claim 1 wherein said polymer sheet is made of transparent polyester material.

4. A blank as set forth in claim 1 wherein said backing layer is a silicone coated paper.

5. A blank as set forth in claim 1 wherein said sheet of paper is of 8½ by 11½ inches.

6. A blank comprising a sheet of paper having a front side for receiving printing thereon and at least one removable section therein, said removable section including a fold line for dividing the section into two equal parts, one of said parts having a grid of perforated lines to subdivide said one part into individually removable sub-sections, the other of said parts being smooth and uninterrupted;

a layer of adhesive over the entire surface of said removable section, said layer providing a rectangular frame of adhesive about the outline of said removable section; and a silicone coated backing sheet disposed over said layer of adhesive to protect said adhesive layer, said backing sheet having a slit adjacent said fold line to enable separation of a part thereof from said layer of adhesive.

7. A blank as set forth in claim 6 wherein said adhesive is pressure sensitive.

8. A blank as set forth in claim 6 wherein said polymer sheet is made of transparent polyester material.

9. A blank as set forth in claim 6 wherein said backing layer is a silicone coated paper.

10. A blank comprising a sheet of paper having a front side for receiving printing thereon and at least one removable section therein, said removable section including a fold line for dividing the section into two equal parts, one of said parts having a grid of perforated lines to subdivide said one part into individually removable sub-sections, the other of said parts being smooth and uninterrupted;

a plurality of adhesive spots on said other part to overlay said sub-sections upon folding of said parts onto each other;

a layer of adhesive over an entire back surface of said sheet of paper and over said adhesive spots, said layer providing a rectangular frame of adhesive about the outline of said removable section;

a polymer sheet disposed over said one part of said removable section to protect said adhesive layer thereon; and a backing layer removably mounted over said other part of said removable section to cover over and protect said adhesive layer thereon.

11. A blank as set forth in claim 10 wherein said layer of adhesive is pressure sensitive.

12. A blank as set forth in claim 10 wherein said polymer sheet is made of transparent polyester material.

13. A blank as set forth in claim 10 wherein said backing layer is a silicone coated paper.

14. A method of forming coupon card comprising the steps of providing at least one removable section in a sheet of paper;

forming a grid of perforated lines in one part of said removable section to define a plurality of sub-sections;

applying a layer of adhesive over said removable section;

applying a backing layer over said layer of adhesive;

removing said backing layer from a part of said removable section; and folding said one part of said removable section over the remaining part of said removable section to adhesively secure said parts together.

15. A method as set forth in claim 14 wherein said backing layer includes a polymer sheet disposed over one part of said removable section and a silicone coated sheet removably disposed over the remaining part of said removable section and wherein said polymer sheet is sandwiched between said parts of said removable section upon folding of said parts over each other.

16. A method as set forth in claim 14 which further comprises the step of applying a plurality of adhesive spots on another of said part of said removable section in alignment with said sub-sections prior to said step of applying said adhesive.

17. A method as set forth in claim 14 wherein a plurality of said removable sections is formed in the sheet of paper.

18. A method as set forth in claim 14 further comprising the step of printing each sub-section with information different from the other of said sub-sections.

* * * * *